United States Patent [19]

Mott

[11] 4,007,905

[45] Feb. 15, 1977

[54] RETRIEVABLE BLOW-OUT PREVENTER RAM SEALS

[75] Inventor: James D. Mott, Houston, Tex.

[73] Assignee: Hydril Company

[22] Filed: Feb. 24, 1975

[21] Appl. No.: 552,540

Related U.S. Application Data

[60] Continuation of Ser. No. 327,627, Jan. 29, 1973, abandoned, which is a division of Ser. No. 127,881, March 25, 1971, Pat. No. 3,737,974.

[52] U.S. Cl. ..... 251/1 R; 166/250; 166/277

[51] Int. Cl.[2] ..... E21B 33/06

[58] Field of Search ..... 251/1, 327; 277/127, 277/185, 188, 208, 209, 211; 166/250, 277, .5

[56] References Cited

UNITED STATES PATENTS

| | | | |
|---|---|---|---|
| 2,752,119 | 6/1956 | Allen et al. | 137/327 |
| 2,912,214 | 11/1959 | Allen et al. | 251/31 |
| 3,272,222 | 9/1966 | Allen et al. | 277/127 |
| 3,561,723 | 2/1971 | Cugini | 251/1 |
| 3,614,111 | 10/1971 | Regan | 251/1 |
| 3,647,174 | 3/1972 | LeRouax | 251/1 |
| 3,741,296 | 6/1973 | Murman et al. | 251/1 |
| 3,744,749 | 7/1973 | LeRouax | 277/127 |

*Primary Examiner*—Martin P. Schwadron
*Assistant Examiner*—G. L. Walton
*Attorney, Agent, or Firm*—Pravel, Wilson & Gambrell

[57] ABSTRACT

Retrievable blowout preventer ram seals which are adapted to be removed and/or inserted with apparatus working on the inside of the well pipe.

53 Claims, 12 Drawing Figures

L
C
20
B
50
30a
30
20a
30
51b
51
51a
50
21
22a
25b
22f
21a
22
52
52a
25d
21b
21d
25c
25a
25d
21c
25
22b
P

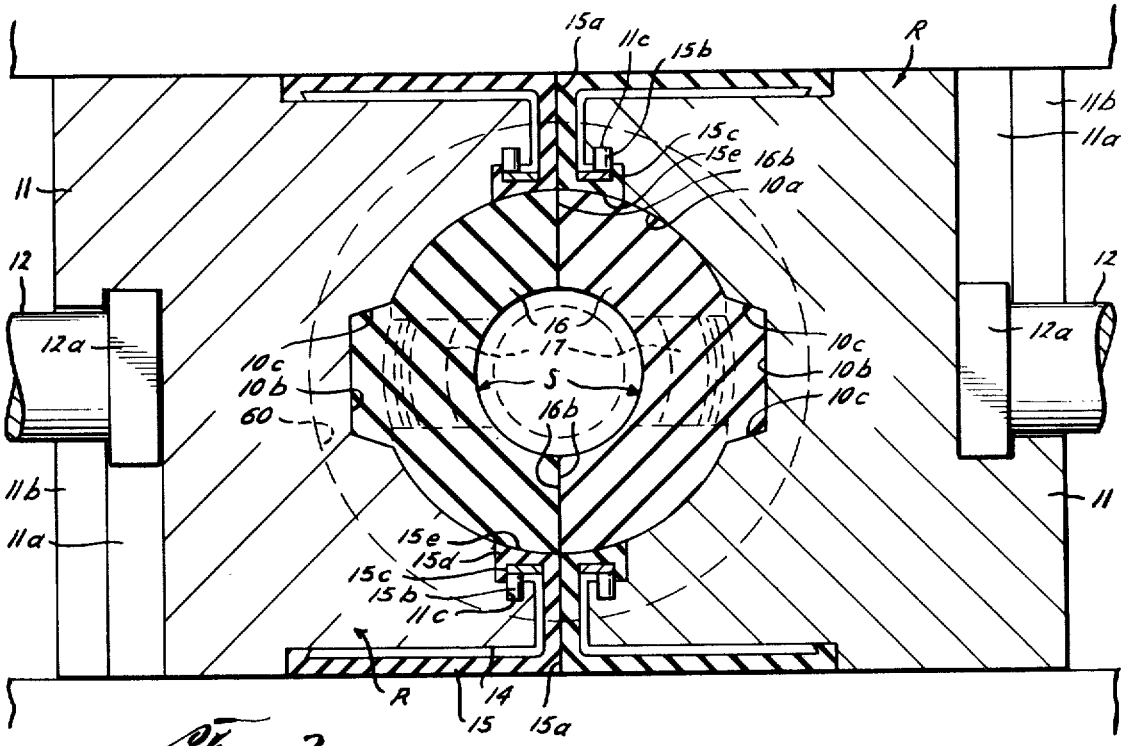
Fig. 3
Fig. 4
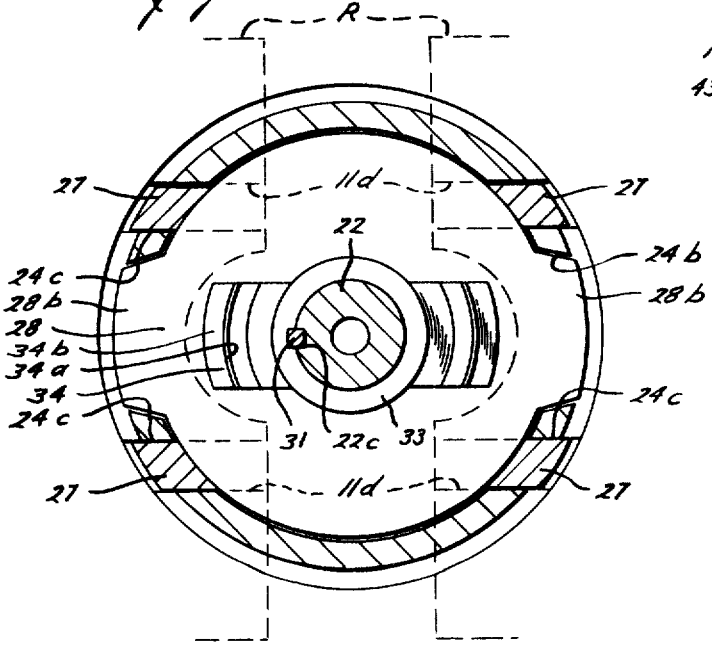
Fig. 10
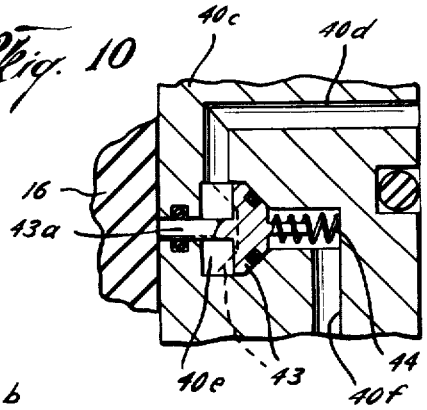

Fig. 5
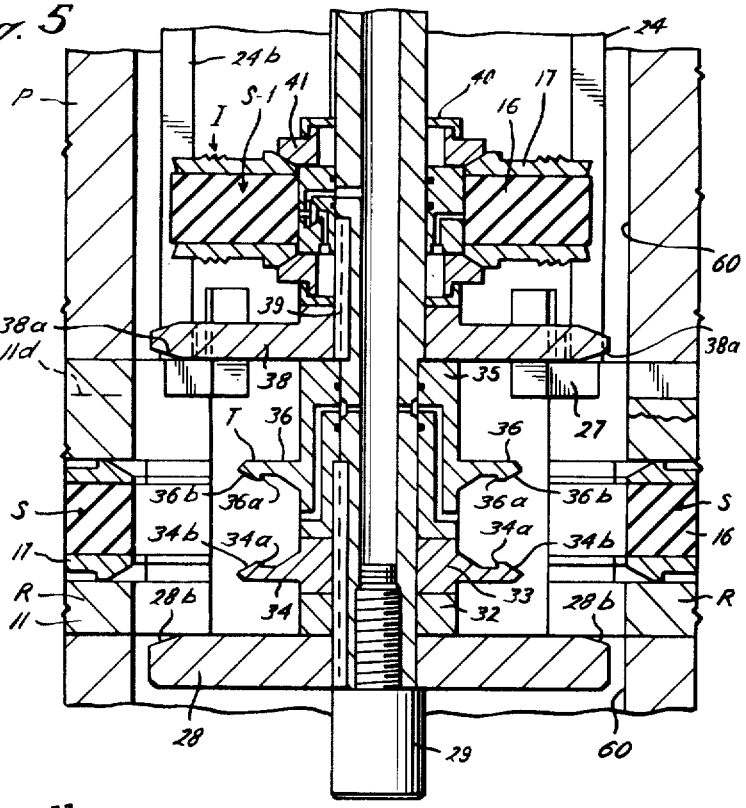
Fig. 5A
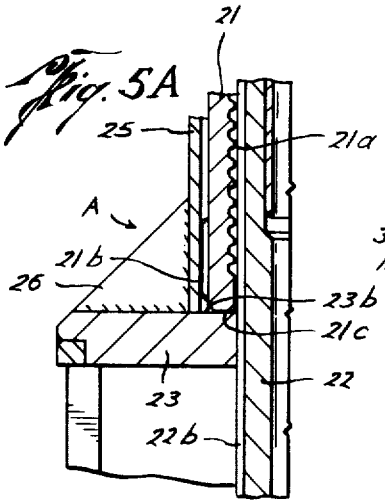
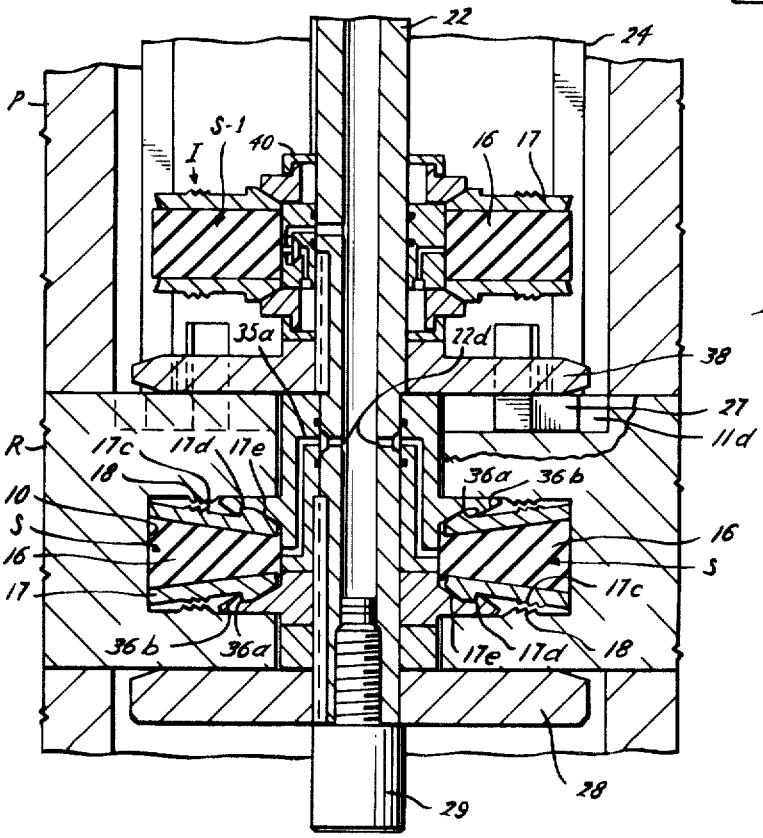
Fig. 6

RETRIEVABLE BLOW-OUT PREVENTER RAM SEALS

CROSS-REFERENCE TO RELATED APPLICATIONS

This is a continuation of application Ser. No. 327,627 filed Jan. 29, 1973 now abandoned, which was a division of Ser. No. 127,881, filed Mar. 25, 1971, now U.S. Pat. No. 3,737,974.

BACKGROUND OF THE INVENTION

The field of this invention is blowout preventers for use on a well casing or well pipe.

Heretofore, blowout preventers have been constructed with ram seals which have been removable by moving the bonnets or heads of the blowout preventer to an open position so as to expose the ram seals for removal and replacement from the outside or externally of the well casing. In recent years, blowout preventers have been used on offshore wells, usually in the water and usually at depths of three hundred feet or more. This requires one or more deep sea divers to go down in the water and effect the opening of the blowout preventers, removal of the old ram seals and replacement with new ram seals. In some cases, the entire blowout preventer must be pulled out of the water. In any event, such past procedures usually have required about 24 hours or more, which is expensive down-time on the well.

SUMMARY OF THE INVENTION

The present invention relates to a new and improved blowout preventer ram seal which is insertable and/or retrievable from inside of the well pipe upon which the blowout preventer is located. The present invention makes it possible to remove old ram seals and replace them with new ram seals in far less time then previously required for such jobs.

BRIEF DESCRIPTION OF THE DRAWINGS

FIG. 3 is a cross-sectional view which is enlarged and illustrates the preferred construction of the ram seals and the rams in which they are mounted;

FIG. 4 is a sectional view taken on line 4—4, and illustrating in detail certain parts of the retrieving tool for the ram seals of the invention;

FIGS. 5 and 5A are vertical sectional views, partly in elevation, illustrating the position of the apparatus after the retrieving tool has been aligned with the retrievable ram seals which are to be removed from the rams;

FIG. 6 is a view similar to FIG. 5, but illustrating a subsequent position of the apparatus with the rams in the closed position about the retrieving tool, and with the retrieving tool engaging the retrievable ram seals;

FIG. 10 is an enlarged fragmentary view illustrating a portion of the fluid flow passage control means utilized for testing with fluid to determine whether the ram seals have been released from the ram seal inserting tool.

DESCRIPTION OF THE PREFERRED EMBODIMENTS

Figure 1A:
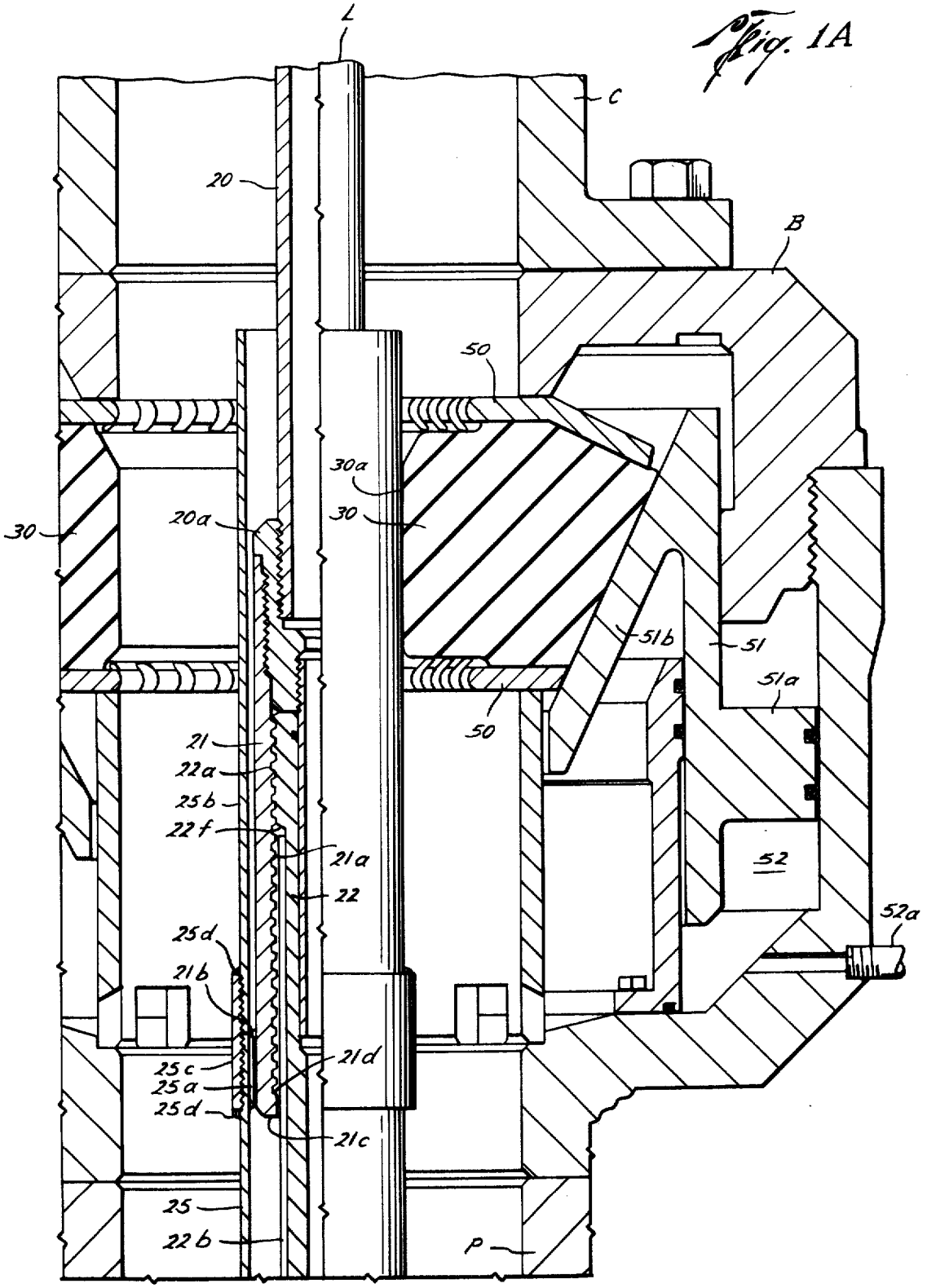
FIG. 1A is a vertical sectional view, partly in elevation, of the upper portion of apparatus in a well casing or pipe having a fluid actuated seal of conventional construction therewith.

In the drawings, the letter A designates generally apparatus which is adapted to be lowered into and removed from a well casing or pipe C (FIG. 1A) which has a seal assembly or blowout preventer B of conventional construction together with a new and improved blowout preventer P having rams R therewith, as will be more fully explained hereinafter. Briefly, the present invention relates to a retrievable ram seal S, two of which are illustrated in the drawings (FIG. 1B) which are releasably attached in recesses 10 of the rams R, as described in detail hereinafter. The apparatus A includes a retrieving tool T (FIG. 1B) and an inserting tool I, both of which are preferably mounted on a lowering string or pipe L which extends to the surface of the well so that the apparatus A can be manipulated for carrying out the method of this invention, as will be explained hereinafter.

Figure 1B:
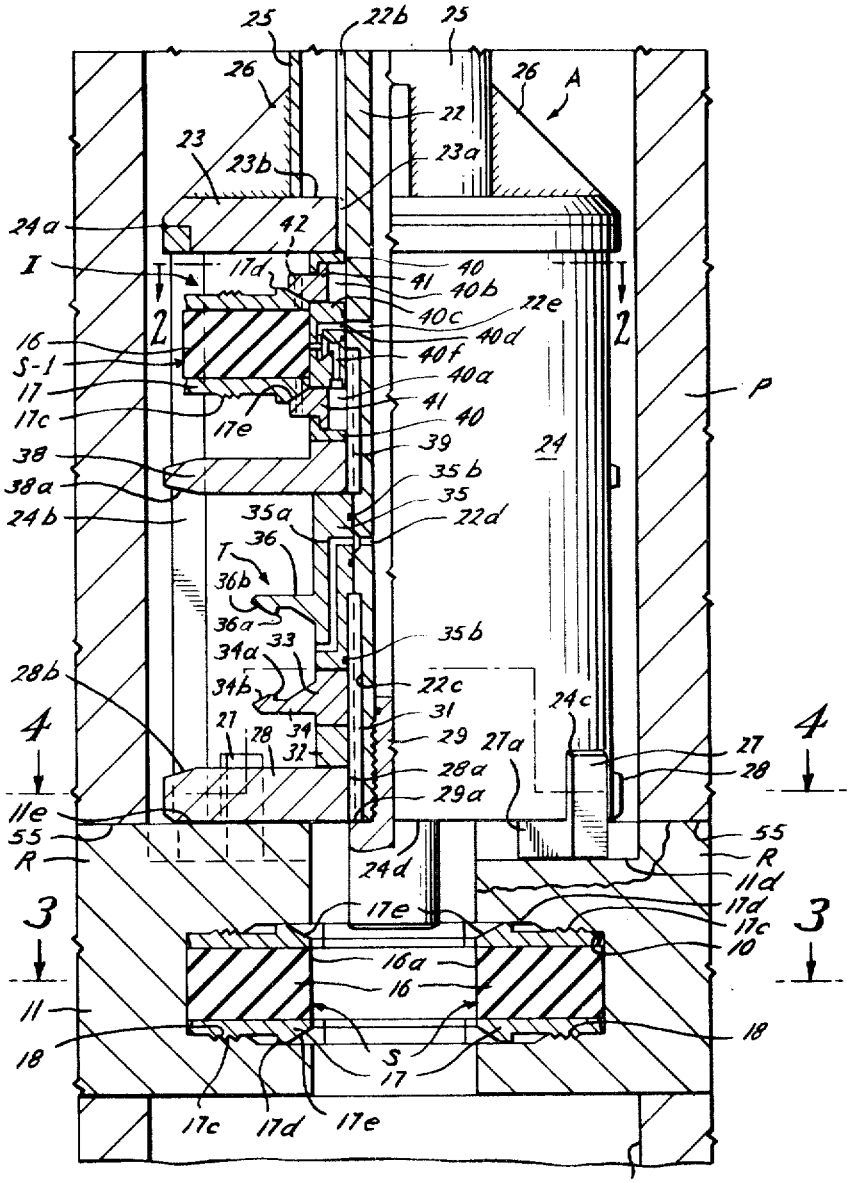
FIG. 1B is a vertical sectional view, partly in elevation, illustrating the lower portion of the preferred form of apparatus in its initially aligned position relative to a pair of rams and ram seals therewith which are to be removed from a blowout preventer.
Figure 2:
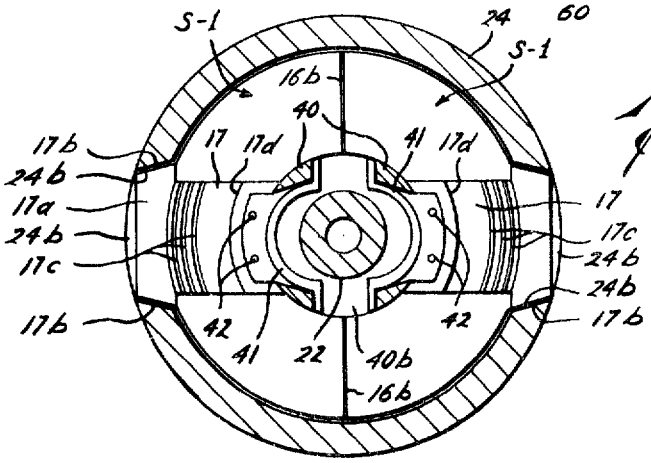
FIG. 2 is a cross-sectional view taken on line 2—2 to illustrate certain details of the apparatus relating to the ram seal inserting tool.

Considering first the details of the ram seal of this invention, reference is made to FIGS. 1B, 2 and 3 in particular. Since the ram seal S for each ram R is identical as illustrated in the drawings, only one of the seals S and its respective ram R will be described, and like letters and numerals will be applied to the other seal S and the ram R therewith. As best seen in the plan view of FIG. 3, the blowout preventer body 11 is of any conventional construction having suitable slots **11*a* and 11*b* for receiving a releasable button 12 on a ram support rod 12*a* which connects in the usual manner to the operating mechanism for moving the ram R inwardly and outwardly relative to the central opening in the well pipe or casing C. As illustrated, the rams R are shown for removal from the side, but they may be removed in any other manner well known in the art. The ram body 11 may be made of metal or any other suitable material and it preferably has a semi-annular groove 14 which receives a semi-cylindrical resilient seal 15 formed of rubber or other suitable material. The resilient seal 15 has a forward section 15*a* which is adapted to abut a corresponding forward section 15*a* on the opposite ram R in the closed position of the rams. The forward section 15*a* extends around and has therewith a pin 15*b* formed of metal and which is secured to a retaining plate 15*c* which in turn is bonded to the rubber or resilient material of the inwardly extending portion 15*d* of the seal 15. The pin 15*b* is adapted to extend into a hole or opening 11c in the ram body 11.**

The ram body 11 has a recess 10 (FIG. 1B) which has an inner curved surface 10a (FIG. 3) forming essentially a semicylindrical surface together with the inner curved surfaces 15e of the inward extension 15d of the seal 15. Preferably, the curved inner surface 10a of the recess 10 of each of the rams R also has a guide groove 10b with tapered side walls 10c which serves to center and properly position the ram seal S, as will be more evident hereinafter.

Each ram seal S includes a generally semi-cylindrical inner face 16a which is curved and is of a radius so that the adjacent sealing members 16 on adjacent seals S are capable of sealing around an external surface of a pipe located in the well pipe or casing for blowout prevention within the casing, as will be well understood. Additionally, each seal member 16 has a flat end surface 16b at each end of the curved surface 16a which engages a corresponding surface 16b on the opposite seal member 16 when the rams R are in the closed position of FIG. 3.

Each ram seal S has a pair of rigid plates 17, preferably formed of steel or other similar material bonded or otherwise secured to the resilient seal member 16. Each plate 17 has an outer guide head 17a with tapered side surface 17b for guiding each ram seal S into the groove 10b of each ram body 11. Thus, the shape of the guide member 17a corresponds to the shape of the guide groove 10b and 17b are substantially the same so as to serve as guiding surfaces for the insertion of the seal S into its respective recess 10.

Also, as will be more fully explained, each plate 17 has a plurality of attachment projections 17c which are adapted to engage with catch means 18 on the upper and lower surfaces of the recess 10 for releasably holding each ram seal S in the recess 10 of each ram R. Each of the projections 17c has a substantially vertical surface at its forward portion towards the bore of the well casing and it has a tapered surface to the rear thereof so that the seal S cannot be pulled out of the catch means 18 unless the plates 17 are reduced in thickness by compressing the resilient seal member 16 sufficiently to a thickness which is less than the distance between the catch means 18. It will be appreciated that any other suitable attaching means 17 and catch means 18 may be employed so long as the seal S is releasably retained in the recess 10.

Each plate 17 also has a retrieving projection or shoulder 17d which are adapted to be engaged by the retrieving tool T, as will be explained hereinafter. The inner or forward portion of each plate 17 is preferably tapered as indicated at 17e for coaction with the retrieving tool T as will also be more evident hereinafter. It should be noted that the ram seals S which are shown in the ram R in FIG. 1B are identical with the replacement or new ram seals S-1, one of which is illustrated in FIG. 1B with the inserting tool I and therefore the same designations are used for the corresponding parts of the seal S-1 as for the seal S.

Considering the apparatus A in more detail, the running-in or lowering string L includes an upper tubular pipe 20 which extends from the surface of the well to a threaded connector 20a which is threaded or otherwise connected to an internally threaded operating sleeve 21. The sleeve 21 has internal left hand threads 21a which are in threaded engagement with external left hand threads 22a on an operating mandrel or tube 22 which extends downwardly and supports the inserting tool I and the retrieving tool T as will be more fully explained. The operating mandrel 22 has a longitudinally extending key or spline 22b which extends downwardly into a keyway 23a in the upper plate 23 which is welded at 24a or is otherwise suitably secured to a cylinder or bell 24, the purpose of which will be more fully explained.

The outer operating sleeve 21 has a lower external key or spline 21b (FIGS. 1A and 5A) which engages a key or spline 25a on an outer tube 25. The outer tube 25 may be formed as a single pipe, but as illustrated, and to facilitate manufacture, such pipe 25 is formed in two sections, with an upper section 25b being coupled to the lower section by means of a connecting sleeve 25c which is preferably welded at 25d to prevent relative rotation of the upper and lower portion of the pipe 25. The upper end of the pipe section 25b may go all of the way to the surface of the well, but preferably it terminates above the upper end of the packing element 30 of the blowout preventer or seal means B, as will be more evident hereinafter.

The lower end of the pipe 25 is welded or is otherwise secured to the upper plate 23, preferably using gusset plate 26 (FIG. 1B) which are welded to the pipe 25 and also to the plate 23.

The bell or cylinder 24 is provided with a pair of longitudinally extending slots 24b, preferably having tapered side walls 24c (FIGS. 2 and 4). The lower end of the cylinder 24 has a plurality of alignment members or lugs 27, preferably four in number, which are welded or are otherwise fixed in notches 24c in the lower portion of the cylinder 24. The lower portion 27a of each lug 27 extends below the lower edge 24d of the cylinder 24, and each of such lugs 27 is adapted to fit within a corresponding slot 11d in the upper surface of each of the ram bodies 11 (FIGS. 1B and 4). As will be more fully explained, the apparatus A is adapted to be rotated initially to align the alignment lugs 27 with the slots 11d so that the lugs 27 drop into such slots 11d when the rams are in the position shown in FIGS. 1B. A first stop plate 28 is carried by the operating mandrel 22 so that it engages the upper surface 11e of each ram body 10 when the alignment lugs 27 are in the proper slots 11d. As will be explained in more detail, the alignment lugs 27 serve to position the retrieving tool T and the inserting tool I in the correct direction relative to the rams R, and the stop plate 28, upon engagement with the upper body surfaces 11e serves to initially locate the apparatus A at a predetermined elevation relative to the rams R. The stop plate 28 is secured to the mandrel 22 by any suitable means such as a retaining hollow pipe or nut 29 having a shoulder 29a which engages the lower surface of the plate 28. A key or spline 31 is disposed in a suitable keyway 28a of the plate 28 and a corresponding keyway 22c of the mandrel 22 (FIGS. 1B and 4) to prevent relative rotation of the plate 28 with respect ro the mandrel 22. Also, the stop plate 28 is formed with side projections 28b which are shaped to fit within the longitudinal slots 24b (FIG. 4) to initially prevent relative rotation between the stop plate 28 and the cylinder 24.

The retrieving tool T is disposed above the first stop plate 28 and it preferably includes a spacer ring 32, a lower finger ring 33 having oppositely disposed retrieving fingers 34 therewith (FIG. 1B and 4). The lower retrieving fingers 34 are each formed with a substantially vertical retrieving surface 34a which is adapted to engage the surface 17*d* of the lower plate 17, as will be more fully explained. The upper surface of each finger 34 which is outwardly of the retrieving surface 34*a* is indicated as being a tapered surface 34*b* for coaction with the tapered surfaces 17*e* of the lower plate 17, as will be further explained.

An upper retrieving finger ring 35 is mounted above the lower retrieving finger ring 33 and it has therewith upper retrieving fingers 36 which are preferably duplicates of the lower retrieving fingers 34, but are faced in the opposite direction so that its retrieving surface 36*a* extends vertically downwardly and its tapered surface 36*b* tapers downwardly and upwardly. All of the rings 32, 33 and 35 are keyed or are otherwise connected to the mandrel 22 by the key 31 so that they are fixed in relationship to the mandrel 22 for rotation therewith as will be explained. Also, the ring 35 has a fluid passage 35*a* for each set of retrieving fingers 34 and 36, which is in communication with the area between each set of such fingers 34 and 36 and is in communication with the bore of the mandrel 22 through a passage 22*d*. Suitable seals 35*b* are provided with respect to the passage 35*a*.

A second stop plate 38 which is of the same general shape as the plate 28 is disposed above the retrieving tool T and it is keyed to the mandrel 22 by a key 39 or any other suitable means so that the plate 38 moves with the mandrel 22. Such plate 38 has a lower annular tapered surface 38*a* which corresponds with an upper tapered surface 28*b*, the purpose of which is to facilitate the centering of the retrieving tool T after the retrieving tool T has moved into a position for retrieving the ram seals S (FIG. 5) as will be more fully explained.

The inserting tool T is mounted on the mandrel 22 above the second stop plate 38 and it includes an annular body 40 which is keyed to the mandrel 22 by any suitable means such as the key 39. The body 40 is formed with lower and upper chambers 40*a* and 40*b*, respectively, in which are received releasable retaining pistons 41 (FIGs. 1B and 2). Each of such releasable retaining pistons 41 is releasably connected to a replacement ram seal S-1 by a plurality of shear pins 42 which extend from the upper piston 41 into the upper plate 17 and also extend from the lower piston 41 into the lower plate 17 for both of the replacement ram seals S-1.

Figure 9:
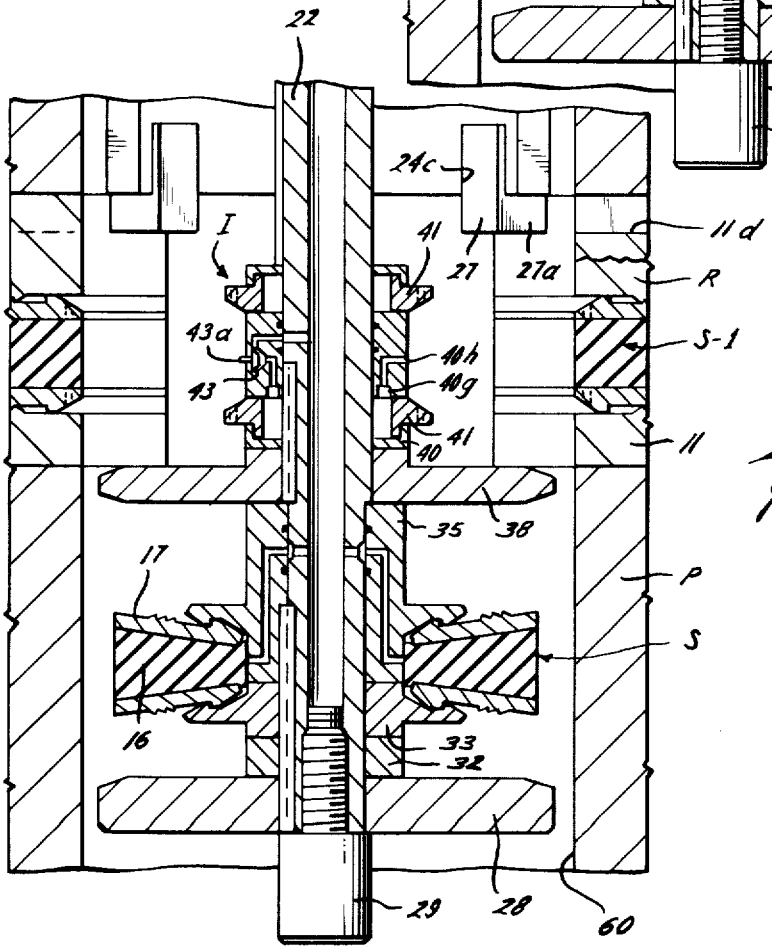
FIG. 9 is a view similar to FIG. 8, but showing the rams retracted to the open position with the new ram seals therewith, and with the apparatus in a position for removal from the well casing or pipe together with the old retrievable ram seals which have been removed from the rams.

The central portion 40*c* of the body 40 is formed with a special fluid passage arrangement for testing to determine when both of the ram seals S-1 have been released from the ram seal insert tool I. Such fluid passage arrangement includes a port 22*e* in the mandrel 22 leading to a passage 40*d* (FIGS. 1B, 9 and 10) in the central body section 40*c*. The passage 40*d* communicates with a chamber 40*e* (FIG. 10) in which a piston 43 is mounted. The piston 43 has a piston stem 43*a* therewith which is engaged by the center resilient seal 16 so long as the seal S-1 is mounted on the pistons 41 as shown in FIG. 1B. A spring 44 to urge the piston 43 outwardly or in a direction towards the ram seal S-1 so that when the ram seal S-1 has been released from the insert tool I, the piston 43 moves to the open position shown in FIG. 9 and the dotted line position shown in FIG. 10, wherein the passage 40*d* is then in communication through the chamber 40*e* with another passage 40*f* which is in communication with an annular passage 40*g* (FIG. 9) and then with a passage 40*h* which is disposed between the upper and lower pistons 41 on the opposite ram seal S-1 (FIG. 9). Thus, when both of the ram seals S-1 are detached from the insert took I, there is fluid communication from the bore of the mandrel 22 to the passage 40*h* which will cause the fluid level in the bore of the mandrel 22 to drop, indicating to the operator that the ram seals S-1 have been released from the insert tool I. If either of the seals S-1 is still on the insert I, the fluid will not drop because the fluid will either be sealed off by reason of the piston 43 being in the closed position of FIG. 10, or the passage 40*h* will be closed off by the seal S-1 positioned in sealing contact therewith.

The lowering string L assumes two different positions other than the running in position shown in FIG. 1A. In the next position, illustrated in FIG. 5A, the lower end 21*c* engages the upper surface 23*b* of the plate 23. In the next position, the mandrel threads 22*a* have been threaded downwardly relative to the outer sleeve 21 until the shoulder 22*f* (FIGS. 1A and 7) engages a shoulder 21*d* on the inner portion of the sleeve 21.

The packing unit or blowout preventer B which is used for holding the outer tube 25 and particularly the upper portion thereof 25*b*, preferably is of the type manufactured by Hydril Company, an example of which is illustrated in the 1966–67 "Composite Catalog" on page 2656. In FIG. 1A, the right hand portion of such blowout preventer B is illustrated in detail, although it should be appreciated that the invention is not limited to the use of that particular blowout preventer. Thus, the blowout preventer B has a packing unit 30 which is formed of molded rubber with integral, segmented metal retaining flanges 50. A contractor piston 51 engages the external portion of the packing unit 30 and causes the internal diameter 30*a* of the packing unit 30 to be reduced for sealing and gripping engagement with the external surface of the tube 25*b*. For this purpose, fluid under pressure is introduced into the chamber 52 through an inlet pipe 52*a* or any other suitable means for imparting an upward movement to the annular piston 51*a* for exerting a compressive force on the packing unit 30 by means of the inclined annular portion 51*b*, as will be well understood. The blowout preventer B is located above the blowout preventer body P (FIG. 1A) which is secured thereto by any suitable means (not shown), with suitable lateral openings 55 (FIG. 1B) in which the rams R are adapted to move laterally in the known manner. The bore 60 of the blowout preventer body P (FIGS. 1B and 3) is the normal opening through the blowout preventer when the rams R are retracted.

Considering now the method of this invention, with the preferred form of the apparatus A, such apparatus A is lowered in the well casing C on the lowering pipe string L, and with the ram seal 30 in the open position shown on the left half of FIG. 1A. The ram 30 on the right half of FIG. 1A is shown in the closed position, but it will be understood that the entire packing 30 moves as a unit and that the packing 30 on the left hand portion of FIG. 1A is merely shown in a different position from that portion on the right hand side of FIG. 1A for illustration purposes. The lowering string L is rotationally connected to the outer pipe or tube 25 because of the splined or keyway connection provided by the interengaging keys 21*b* and 25*a* on the threaded sleeve 21 and the tube 25, respectively (FIG. 1A). The lowering string L is lowered until the lugs 27 engage the upper surfaces 11*e* of the rams R, when the rams R are in the closed position of FIG. 1B. The aligning lugs 27 drop into the slots lid in the upper surface of the rams R when they are aligned therewith and to accomplish such alignment, the lowering string L is rotated to the left until the lugs 27 drop into the slots 11*d*, at which time further rotation is prevented. Also, because of the arrangement of the lugs 27, only two possible positions of the apparatus A are possible when the lugs 27 are in the slots 11*d*, and either position results in the alignment of the retrieving tool T and the inserting tool I directly above the recesses 10 in the rams R.

When the lugs 27 drop into the slots 11*d*, the lower stop plate 28 engages the upper surfaces 11*e* of the rams R (FIG. 1B.) to thereby locate the apparatus A at a predetermined elevation relative to the rams R. During such alignment of the apparatus A both as to direction and elevation, the packing unit 30 is in the open position shown in the left half of FIG. 1A, but after such alignment, the blowout preventer B is actuated to move it to the closed position shown in the right half of FIG. 1A so that the upper tube portion 25*b* is engaged and is held against rotational and longitudinal movement by the gripping contact of the packing unit 30 with such tube 25*b*. With the tube 25*b* and the rest of the tube 25 therebelow thus held by the blowout preventer B, the rams R are moved outwardly to the open position shown in FIG. 5 wherein the inner surfaces of the rams R are substantially in alignment with the bore 60 of the blowout preventer P. After the rams R have thus been moved to their open position, the lowering string L may be lowered relatively to the outer pipe 25 and its upper portion 25*b* so that the spline or key 21*b* slides downwardly relative to the spline or key 25*a* to release the driving rotational engagement therebetween. Such lowering continues until the lower end 21*c* of the sleeve 21 engages the upper surface 23*b* (FIG. 5A) of the plate 23. The amount of such downward movement is predetermined and depends upon the initial position of the end 21*c* with respect to the surface 23*b* and its final resting position in contact therewith so that when the surface or end 21*c* engages the surface 23*b*, the fingers 34 and 36 of the retrieving tool T are aligned with the ram seals S in each of the rams R (FIG. 5).

It is to be noted that the lower stop plate 28 is disposed at the lower surface of the rams R and the lower surface of the upper plate 30 is disposed at the upper surface of the rams R after the apparatus A has been moved downwardly to the position shown in FIG. 5. By reason of such position, the rams R move between the plates 28 and 38 and the beveled surfaces 28*b* and 38*a* assure the accurate location of the retrieving tool T with respect to the ram seals S.

As the rams R are moved inwardly toward each other from the position shown in FIG. 5 to the position shown in FIG. 6, the tapered surfaces 17*e* of the plate 17 engage the tapered surfaces 34*b* and 36*b* of each set of the fingers 34 and 36, respectively. The coaction between such surfaces causes a squeezing or reduction in thickness of the rubber or resilient central seal portion 16 at the inner parts of the ram seals S. Such squeezing continues until the rams R have moved inwardly their maximum distance and the ram seals S are in the position shown in FIG. 6, wherein the latch projections or surfaces 17*d* are firmly locked behind the retrieving surfaces 34*a* and 36*a* of the two sets of retrieving fingers 34 and 36, respectively. Such compression of the central resilient seal member 16 by the squeezing of the plates 17 together for each of the ram seals S as best seen in FIG. 6, accomplishes a release of the attachment projections 17*c* on the plates 17 from the catch projections 18 on the inside of the recess 10. Thereafter, the rams R are moved outwardly away from each other, and the ram seals S are retrieved from the rams R because of their being latched to the retrieving finger 34 and 36 of the retrieving tool T. The operator at the surface may test to determine whether or not both of the ram seals S have been retrieved by simply filling the bore of the mandrel 22 and the lowering string L thereabove with mud or other liquid. If the ram seals are both in the position shown in FIG. 6, the fluid passages 35*a* are closed off by the central sealing member 16 so that the level of fluid within the pipe or string L remains at a fixed point, indicating to the operator that both ram seals S have been retrieved. If leakage develops, the operation for the retrieval of the ram seals S is repeated by moving the rams R inwardly again to attempt to latch the ram seal or seals S which have not been latched by the first engagement with the fingers 34 and 36.

Figure 7:
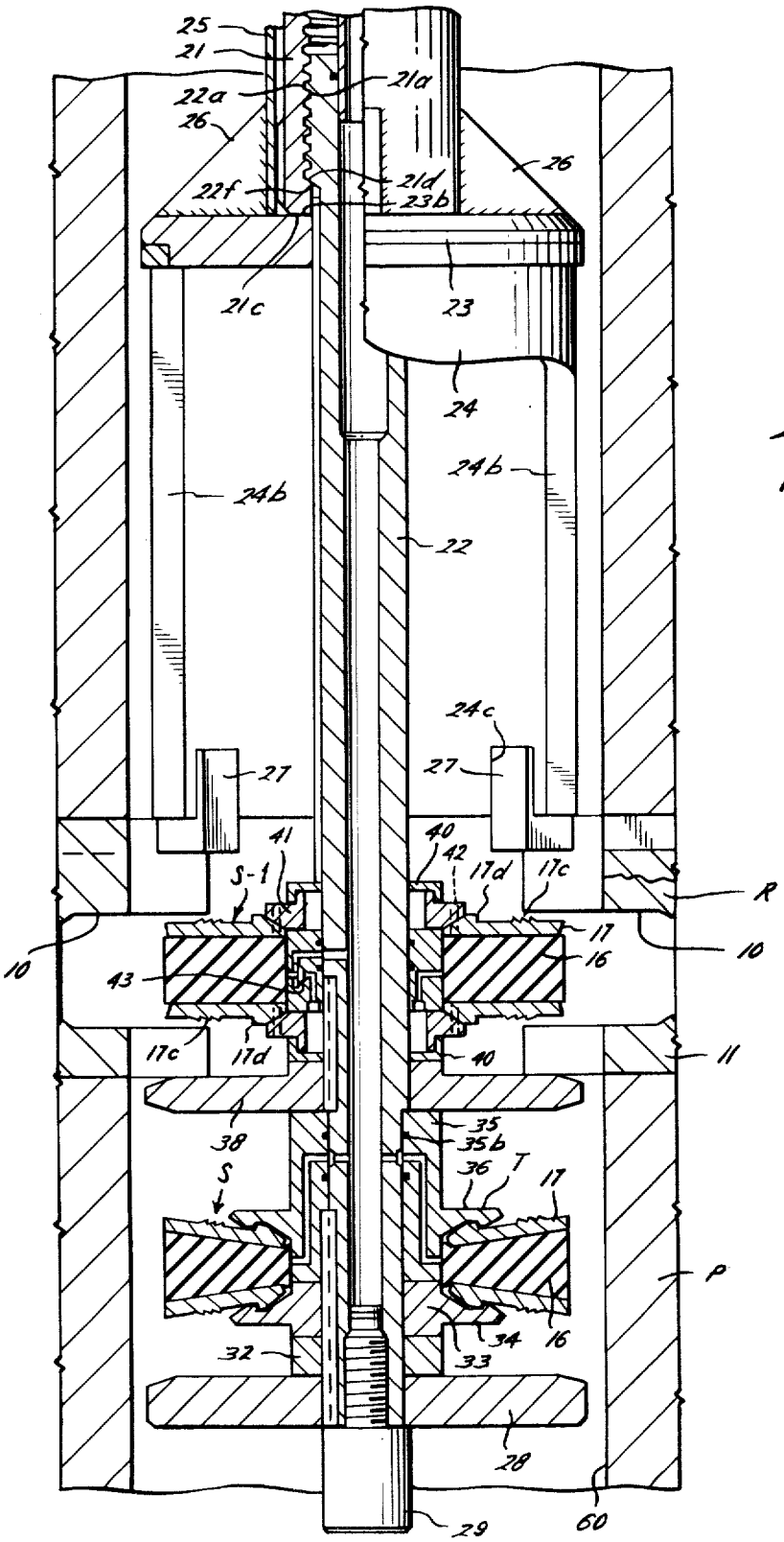
FIG. 7 is a vertical sectional view, partly in elevation, illustrating the apparatus in a subsequent position wherein the ram seal inserting tool with rams thereon is in position opposite the ram recesses for the insertion of the new ram seals into the rams.

After the ram seals S have been removed from the rams R, and the rams R are moved outwardly to the open position shown in FIG. 7, the recesses 10 in the rams R are then available for the reception of the new or replacement ram seals S-1 (FIG. 7). Since the threads 21*a* and 22*a* on the sleeve 21 and the mandrel 22, respectively, are preferably left hand threads, the lowering string L, is next rotated in a right hand direction to cause the mandrel 22 to be threaded downwardly relative to the sleeve 21 until the surfaces 21*d* and 22*f* are in engagement with each other (FIG. 7). Such engagement between the surfaces 21*d* and 22*f* serves as a stop for the mandrel 22 and thus locates the replacement ram seals S-1 at the correct elevation between the rams R for inserting the ram seals S-1 into the recesses 10 thereof. It is to be noted that the retrieving tool T with the removed ram seals S are disposed below the rams R in such position (FIG. 7).

Figure 8:
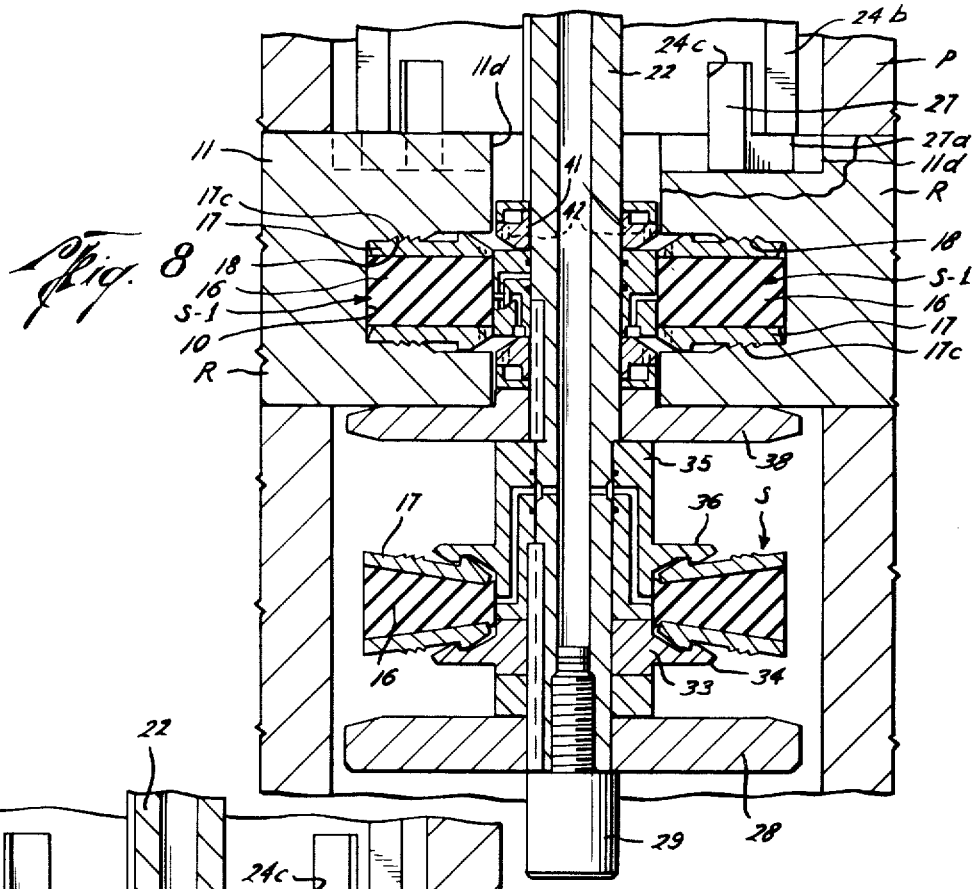
FIG. 8 is a view similar to FIG. 7, but illustrating the apparatus after the rams have been moved inwardly for receiving the new ram seals from the ram seal inserting tools.

The rams R are then moved inwardly towards each other, causing the inward substantially vertical edge 11*d* of the ram body 11 of each of the rams R to engage the movable releasable holding plates 41 so as to shear the shear pins 42 and then move the members 41 from the position shown in FIGS. 1B and 2 to the position shown in FIG. 8. Simultaneously with such shearing action, the replacement ram seals S-1 are forced into the recesses 10 of the rams R. Due to the taper on the outward portions of the attachment projection 17*c* the ram seals S-1 simply compress slightly and slide over the catch projections 18 in the recess 10 until the ram seals S-1 are in the fully seated position in the recesses 10, at which point the resiliency of the central member 16 urges the plates 17 outwardly to fully engage the attachment projections 17*c* in the catch projections 18, thereby locking the ram seals S-1 in the arms R.

The rams R are then moved outwardly to the open position shown in FIG. 9 so that the entire Apparatus A can then be removed from the well casing C leaving only the replacement ram seals S-1 in position in the rams R and removing the old ram seals S with the apparatus A. Prior to removing the apparatus A from the well casing C, it is desirable to test to determine whether both of the ram seals S-1 have been released from the inserting tool I. This is accomplished by observing whether the level of the fluid in the lowering string L drops following the movements of the rams R for the insertion of the ram seals S-1, as previously explained. In other words, if both of the ram seals S-1 have been properly inserted into the rams R, the fluid level in the lowering string L will drop because the fluid will be released or discharged through the passage **40*h***, as previously explained. However, should either of the ram seals S-1 still be on the inserting tool I, the fluid level in the lowering string L will not drop and the operator will thus be informed of the condition. Should the operator determine that both of the ram seals S-1 have not been inserted into the rams R, the movements of the rams R inwardly and outwardly are repeated and then a new test with the fluid in the lowering string L is made so that the operator can be certain that the ram seals S-1 are both in the proper position in the rams R before the apparatus A is removed from the well casing C.

Although the apparatus A and the method have been specifically described for the embodiment illustrated in the drawings, wherein the apparatus A has both the inserting tool I and the retrieving tool T on a single assembly, the inserting tool and retrieving tool may be each lowered on a separate lowering string at different times so that the retrieving operation and in the inserting operation are conducted with separate apparatus and at different times. For example, the retrieving tool T may be lowered without the inserting tool I and then after the ram seals S have been removed from the rams R, the retrieving tool T may be removed from the well casing. Thereafter, the inserting tool I may be lowered on the lowering string L or any other suitable support and then positioned for the insertion of the replacement ram seals S-1 in the rams R.

The foregoing disclosure and description of the invention are illustrative and explanatory thereof, and various changes in the size, shape, and materials as well as in the details of the illustrated construction may be made without departing from the spirit of the invention.

What is claimed is:

1. An improved ram seal for a ram type blowout preventer having reciprocating ram means operably carrying the improved ram seal apparatus, said improved ram seal apparatus comprising a resilient ram seal body for blocking undesired flow through the flow passage of the blowout preventer, wherein the improvement comprises:

means with said ram seal body for releasably securing said ram seal body to the blowout preventer ram means from inside the flow passage of the blowout preventer.

2. The improved ram seal as set forth in claim 1, wherein:

said means for releasable securing including attaching plates secured above and below the inner sealing surface of the ram seal body.

3. The improved ram seal as set forth in claim 2, wherein:

each of said plates having attaching means for releasably attaching said ram seal body to catch means on a movable ram means.

4. The improved ram seal as set forth in claim 2, wherein:

each of said plates having means for engagement by a retrieving tool.

5. The improved ram seal as set forth in claim 2, including:

each of said plates having means for engagement by a retrieving tool to actuate said means for releasably securing to enable said improved ram seal apparatus to be retrieved from said ram member while inside the blowout preventer.

6. The improved ram seal as set forth in claim 1, wherein:

said means for releasably securing having projections engageable with a catch means on the ram means for resisting release of said improved ram seal apparatus from the ram means.

7. The improved ram seal as set forth in claim 1, wherein:

said means for releasable securing with the ram means actuated by movement of the ram means for securing the improved ram seal apparatus with the ram means.

8. The improved ram seal as set forth in claim 1, wherein:

said means for releasable securing with the ram means actuated when the ram means is reciprocated to a position blocking the flow passage of the blowout preventer to secure the improved ram seal apparatus with the ram means.

9. An improved ram seal for a ram type blowout preventer having a reciprocating ram means carrying a resilient ram seal for blocking undesired flow through the flow passage of the blowout preventer, wherein the improvement comprises:

a pair of plates secured to a resilient seal;

each of said plates having means for releasably securing the improved ram seal apparatus with the ram means; and each of said plates having means for engagement from inside the flow passage by a retrieving tool for actuating said means for releasably securing to release the improved ram seal apparatus from the ram means.

10. The improved ram seal as set forth in claim 9, wherein:

said pair of plates are secured on opposide sides of said resilient ram seal to enable said resilient seal to be compressed between said plates.

11. The ram seal as set forth in claim 9, wherein:

said means for engagement having a projection on each of said plates for engagement by the retrieving tool for compressing the resilient ram seal to release said means for releasably securing.

12. A blowout preventer ram seal adapted for releasably securing with ram means of a ram type blowout preventer from inside a flow passage formed through the blowout preventer, the ram means mounted with the blowout preventer for reciprocating movement to and from a first position disposed in said flow passage for blocking flow of fluid through the flow passage and a second position disposed outwardly of the flow passage for enabling flow of fluid through the flow passage, comprising:

a resilient ram seal body having a sealing surface; and means with said ram seal body for releasably securing said ram seal body to the ram means from inside the flow passage of the ram type blowout preventer.

13. The ram seal as set forth in claim 12, wherein:

the releasable securing means having means for releasably attaching the ram seal apparatus with the ram means by movement of the ram means.

14. The ram seal as set forth in claim 12, wherein:

the releasable securing means having means for releasably attaching the ram seal apparatus with the ram means reciprocally moved to the first operating position within a ram-type blowout preventer from the second position.

15. The ram seal as set forth in claim 12, wherein:

said releasable securing means includes attaching plates secured above and below the inner sealing surface of the ram seal body.

16. The ram seal as set forth in claim 15, wherein:

each plate having attaching means for releasably attaching said ram seal body to catch means on a movable ram means.

17. The ram seal as set forth in claim 15, wherein:

said ram seal body having retrieving means on each of said plates for engagement by a retrieving tool.

18. The ram seal as set forth in claim 15, including:

retrieving projections on each of said plates for engagement by a retrieving tool to compress said seal body and the attaching plates to a height less than the distance between upper and lower surfaces of a ram recess mean to thereby enable said seal to be retrieved from inside a blowout preventer.

19. The ram seal as set forth in claim 16, wherein:

said attaching means having projections engageable with the catch means on the ram means for resisting release of said seal means from the ram means.

20. A blowout preventer ram seal for removal from and insertion into a recess in the movable flow blocking ram of a ram blowout preventer from inside the blowout preventer, comprising:

a resilient ram seal body having an inner sealing surface;

releasable attachment means with said ram seal body for releasably attaching said body to the ram while the ram is inside the blowout preventer;

said ram also has catch means engageable by said releasable attachment means when said seal is positioned in said ram recess;

said attachment means includes attaching plates secured above and below said ram seal body;

each of said plates and said catch means having co-acting projections engageable with each other for resisting release of said seal from said ram;

said catch means includes upper and lower catch projections;

said co-acting projections have tapered co-acting guide surfaces for squeezing said seal body between said plates as said ram seal is forced into said recess to a height which is less than the distance between said upper and lower catch projections; and said co-acting projections have co-acting retaining surfaces which engage each other to prevent removal of said ram seal from said ram until said surfaces are disengaged by a compression of at least a portion of said seal body to reduce the height thereof to less than the distance between said upper and lower catch projections.

21. A blowout preventer ram seal apparatus having means enabling seal removal from and insertion into a controlled reciprocating flow blocking ram of a ram type blowout preventer from inside the flow passage which extends through the ram type blowout preventer, comprising:

a blowout preventer ram means mounted for reciprocating movement inside a ram-type blowout preventer to and from a first operating position disposed in said flow passage for blocking flow of fluid through the blowout preventer and a second operating position outwardly of said flow passage for enabling flow of fluid through the blowout preventer;

a resilient ram seal body having an inner sealing surface; and means with said ram seal body for releasably attaching said ram seal body to said movable ram from inside the flow passage while said ram means is reciprocally moved to the first operating position within the ram-type blowout preventer from the second operating position.

22. The ram seal set forth in claim 21, wherein:

said releasable attaching means includes attaching plates secured above and below the inner sealing surface of the ram seal body and each plate having attaching means for releasably attaching said ram seal body to said movable ram.

23. The apparatus set forth in claim 22, wherein:

said ram seal body having retrieving means on each of said plates for engagement by a retrieving tool.

24. The apparatus set forth in claim 22, wherein:

said ram means having catch means for releasably securing with said attaching means.

25. Improved apparatus for blocking undesired flow through the flow passage of a ram blowout preventer, wherein the improvement comprises:

a blowout preventer ram body reciprocally mountable in a ram type blowout preventer for movement to and from a first operating position disposed in the flow passage for blocking flow of fluid through the flow passage and a second position disposed outwardly of the flow passage for enabling flow of fluid through the flow passage;

a resilient ram seal having a fluid sealing surface; and means with said resilient ram seal for releasably securing said resilient ram seal with the blowout preventer ram body from inside the flow passage of the ram type blowout preventer.

26. The improved apparatus of claim 25, wherein:

said means for releasable securing is actuated by movement of said ram body.

27. The improved apparatus of claim 25, wherein:

said means for releasably securing the ram seal with the ram body is actuated by movement of the ram body toward the first position for blocking the flow passage of the blowout preventer.

28. The improved apparatus as set forth in claim 25, wherein:

said ram body having a recess for receiving said resilient ram seal from inside the flow passage wherein said resilient ram seal is secured with said ram body.

29. The improved apparatus as set forth in claim 25, wherein:

said ram seal having a plate member secured with said resilient seal.

30. The improved apparatus as set forth in claim 29, wherein:

said plate member mounts said means for releasably securing said ram seal with the ram body from inside the flow passage when the ram body is mounted in the blowout preventer.

31. The improved apparatus as set forth in claim 25, wherein:

said ram body having catch means for coacting with said means for releasably securing the ram seal with the ram body from inside the flow passage for effecting securing when said ram seal is received in said ram body.

32. The improved apparatus as set forth in claim 31, wherein:

said ram seal having means for engagement by a retrieving tool disposed in the flow passage for releasing said ram seal from said ram body.

33. A blowout preventer ram seal apparatus for removal from and insertion into a controlled reciprocating flow blocking ram of a ram type blowout preventer from inside the flow passage which extends through the ram type blowout preventer, comprising:

a blowout preventer ram means mounted for reciprocating movement inside a ram-type blowout preventer to and from a first operating position disposed in said flow passage for blocking flow of fluid through the blowout preventer and a second operating position outwardly of said flow passage for enabling flow of fluid through the blowout preventer;

a resilient ram seal body having an inner sealing surface;

means with said ram seal body for releasably attaching said ram seal body to said movable ram from inside the flow passage while said ram means is reciprocally moved to the first operating position within the ram-type blowout preventer from the second operating position;

said releasable attaching means includes attaching plates secured above and below the inner sealing surface of the ram seal body and each plate having attaching means for releasably attaching said ram seal body to said movable ram;

said ram seal body having retrieving means on each of said plates for engagement by a retrieving tool;

said ram means having catch means for releasably securing with said attaching means; and said attaching means and said catch means having co-acting projections engageable with each other for resisting release of said seal from said ram.

34. The structure set forth in claim 33, including:

retrieving projections on each of said plates for engagement by a retrieving tool to compress said seal body to a height less than the distance between said upper and lower catch projections to thereby enable said seal to be retrieved from the recess in the ram.

35. An improved ram means for a ram type blowout preventer for releasably receiving a resilient retrievable sealing means from inside the flow passage of the blowout preventer, wherein the improvement comprises:

a blowout preventer ram body mountable in a ram type blowout preventer; and said ram body having means for releasably receiving the resilient sealing means for securing with the ram body through the flow passage of the blowout preventer.

36. The improved ram means as set forth in claim 35, wherein:

said ram body having a recess for operably receiving the retrievable resilient sealing means.

37. The improved ram means as set forth in claim 35, wherein:

the ram means having a guide means for positioning the resilient sealing means relative to the ram means when releasably securing the resilient sealing means with the ram means.

38. The improved ram means as set forth in claim 35, wherein:

the ram body having a recess for operably receiving the retrievable resilient sealing means by movement of the ram inside the flow passage.

39. The improved ram means of claim 38, wherein:

said recess forming upper and lower surface having catch means on the upper and lower surfaces of the recess to which means for releasably securing carried on the resilient sealing means engage for securing.

40. The ram as set forth in claim 39, wherein:

the catch means having projections on the upper and lower surfaces releasably securable with attachment means on a ram seal when the ram is in the first position.

41. An improved ram means for a ram type blowout preventer, said ram means reciprocally movable to block a flow passage through the blowout preventer as desired, the improvement comprising:

a ram body having means for receiving a resilient ram seal from inside the flow passage when said ram body is operably mounted in the ram type blowout preventer; and means with said ram body for aligning the resilient ram seal with said ram body for installing or retrieving the resilient ram seal apparatus from inside the flow passage while the ram body is operably mounted in the ram type blowout preventer.

42. The improved ram means as set forth in claim 41, wherein:

said means for aligning comprising a slot formed in said ram body for receiving a lug from a tool apparatus for aligning the ram seal tool apparatus with said ram body for installing or retrieving the resilient ram seal with the ram body from inside the flow passage.

43. The improved apparatus of claim 41, wherein:

said means for aligning means comprising a surface on said ram body for engagement by the tool apparatus for aligning the tool apparatus in the blowout preventer flow passage to install or retrieve the resilient ram seal.

44. A ram means adapted for use in a ram type blowout preventer forming a flow passage, said ram means having attachably thereto a resilient sealing means thereto from inside the flow passage while said ram means is operably disposed in the ram type blowout preventer, comprising:

a blowout preventer ram body mountable in a ram type blowout preventer for reciprocating operating movement substantially transverse to the blowout preventer flow passage to and from a first position disposed in said flow passage for blocking flow of fluid through the blowout preventer and a second position outwardly of said flow passage for enabling flow of fluid through the flow passage; and means with said ram body for releasably receiving and having secured with said ram body a resilient sealing means disposed within the flow passage while said ram body is operably disposed in the ram type blowout preventer.

45. The ram means as set forth in claim 44, wherein:

said releasable securing means having means for securing the ram means with the resilient sealing means by operating movement of said ram body.

46. The ram means as set forth in claim 44, wherein:

said releasable securing means having means for securing the ram means with the resilient sealing means by movement of the ram means to a position blocking the flow passage of the blowout preventer.

47. The ram means as set forth in claim 44, wherein: said ram body means having a recess for receiving the resilient sealing means through the flow passage.

48. The ram means as set forth in claim 47, wherein: said recess is substantially a semi-annular groove for receiving the resilient sealing means.

49. The ram means as set forth in claim 47, wherein: said recess having a guide groove to center and properly position the resilient sealing means.

50. The ram means as set forth in claim 44, wherein: said releasable securing means having catch means for releasably securing with the resilient sealing means.

51. The ram means as set forth in claim 50, wherein: said catch means having projections engageable with co-acting projections formed on the resilient sealing means for releasably securing said sealing means in said ram groove.

52. A blowout preventer ram seal for removal from and insertion into a movable flow blocking ram means of a ram blowout preventer from inside the blowout preventer, comprising:

a resilient ram seal body having an inner sealing surface;

attaching plates secured to the ram seal body above and below said ram seal body for releasably attaching said body to the ram means disposed inside the blowout preventer;

each of said plates having projections engageable with projections formed on the ram means for resisting release of said seal body from the ram means; and said plate projections having tapered guide surfaces for enabling the projections formed on said plates to move relative to the projections on the ram means into engagement for resisting release of said seal body from the ram means wherein said ram seal apparatus is secured to the ram means.

53. A ram means for use in a ram type blowout preventer, said ram means having a recess for receiving a ram seal apparatus having a resilient ram seal body and releasable securing means for releasably attaching said resilient ram seal body to said ram means while said ram means is operably disposed within the blowout preventer, comprising:

a ram means forming a recess and having catch means engageable by releasable attachment means on a ram seal apparatus when a said ram seal apparatus is positioned in said ram recess;

said catch means having upper and lower projections engageably co-acting with the ram seal apparatus for resisting release of the ram seal apparatus from said ram means; and said catch means projections have retaining surfaces which engage on the ram seal apparatus to prevent removal of the ram seal apparatus from said ram recess until surfaces on the ram seal apparatus is disengaged from said upper and lower catch projections.

* * * * *